US007768475B2

(12) United States Patent
Tessier

(10) Patent No.: US 7,768,475 B2
(45) Date of Patent: Aug. 3, 2010

(54) SMALL-GAP PLASMA DISPLAY PANEL WITH ELONGATE COPLANAR DISCHARGES

(75) Inventor: Laurent Tessier, Fontaine (FR)

(73) Assignee: Thomson Plasma, Boulogne Billancourt (FR)

( * ) Notice: Subject to any disclaimer, the term of this patent is extended or adjusted under 35 U.S.C. 154(b) by 1068 days.

(21) Appl. No.: 10/981,427

(22) Filed: Nov. 4, 2004

(65) Prior Publication Data

US 2006/0092101 A1 May 4, 2006

(30) Foreign Application Priority Data

Nov. 7, 2003 (FR) ..... 03 50814

(51) Int. Cl.
*G09G 3/28* (2006.01)

(52) U.S. Cl. ..... 345/60

(58) Field of Classification Search ..... 313/582, 313/585; 345/60; 428/697
See application file for complete search history.

(56) References Cited

U.S. PATENT DOCUMENTS

| | | | | |
|---|---|---|---|---|
| 5,841,232 | A * | 11/1998 | Hirao et al. | 313/585 |
| 6,295,040 | B1 | 9/2001 | Nhan et al. | 345/60 |
| 6,362,799 | B1 * | 3/2002 | Ueoka et al. | 345/60 |
| 6,768,262 | B2 * | 7/2004 | Ahn et al. | 313/582 |
| 7,265,490 | B2 * | 9/2007 | Yoon | 313/582 |
| 2002/0130618 | A1 | 9/2002 | Hasegawa et al. | 313/584 |
| 2003/0067425 | A1 * | 4/2003 | Tokunaga et al. | 345/60 |
| 2004/0169471 | A1 * | 9/2004 | Bettinelli et al. | 313/582 |
| 2004/0252082 | A1 * | 12/2004 | Lacoste et al. | 345/63 |
| 2005/0003237 | A1 * | 1/2005 | Lee | 428/697 |

FOREIGN PATENT DOCUMENTS

| | | | |
|---|---|---|---|
| EP | 1 294 006 | A2 | 3/2003 |
| EP | 1294006 | A2 * | 3/2003 |
| FR | 0350814 | | 11/2003 |
| WO | WO 02/065441 | A2 | 8/2002 |

OTHER PUBLICATIONS

European Search Report.
A New Method to Reduce Addressing Time in a Large AC Plasma Display Panel; XP 001082391; IEEE Transactions on Electron Devices, vol. 48, No. 6, Jun. 2001.

* cited by examiner

*Primary Examiner*—Amr Awad
*Assistant Examiner*—Waseem Moorad
(74) *Attorney, Agent, or Firm*—Robert D. Shedd; Patricia Verlangieri

(57) ABSTRACT

A display panel provided with at least two arrays of coplanar electrodes Y, Y' and a network of address electrodes X is described. The network of address electrodes X is formed between the plates bearing these electrodes and has a two-dimensional set of elementary discharge regions. Each elementary discharge region is subdivided into two matrix discharge regions, each located at the intersection of one Y of the coplanar electrodes and of the address electrode X and one coplanar discharge region between the coplanar electrodes Y, Y'. Each matrix discharge region is located closer to the external edge than the internal edge of the coplanar electrode Y with which the matrix discharge region is associated.

7 Claims, 7 Drawing Sheets

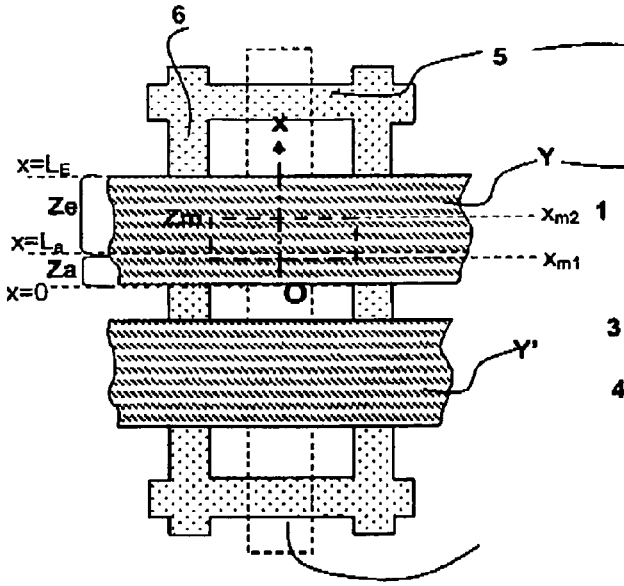
Fig.1-A – Prior Art
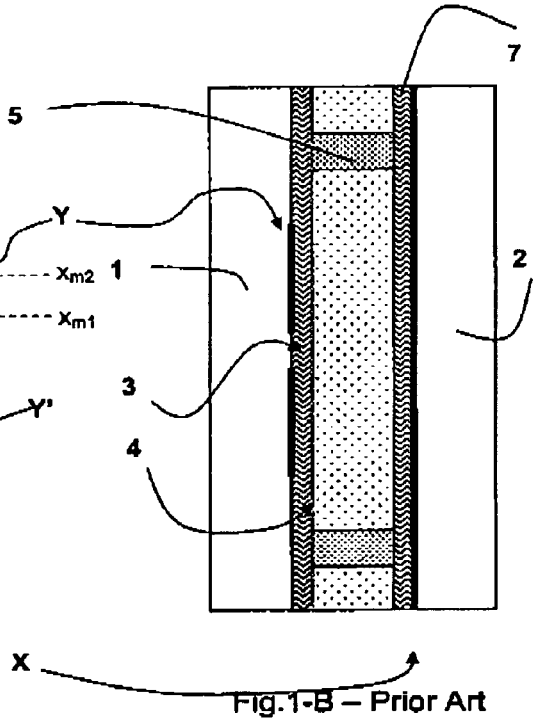
Fig.1-B – Prior Art
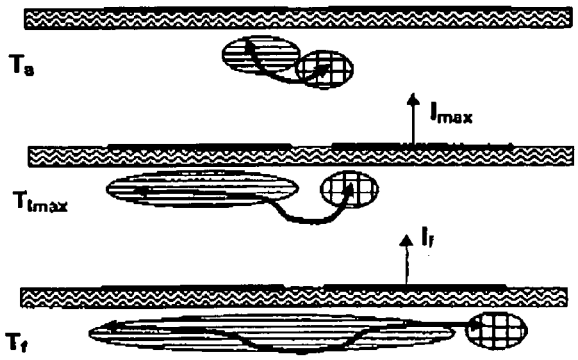
Fig.2-A - Prior Art
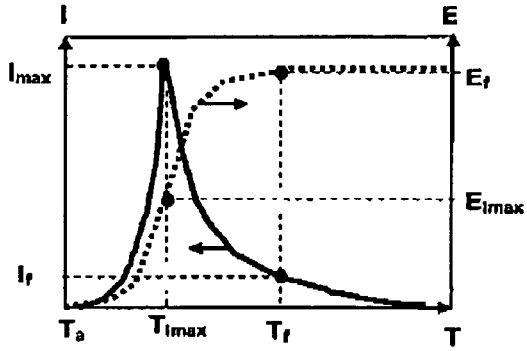
Fig.2-B – Prior Art

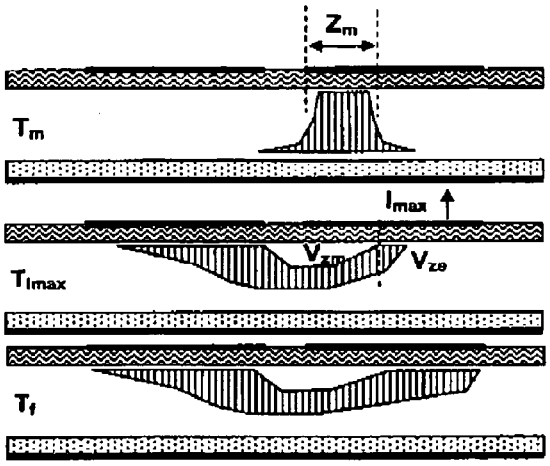
Fig.3-A – Prior Art
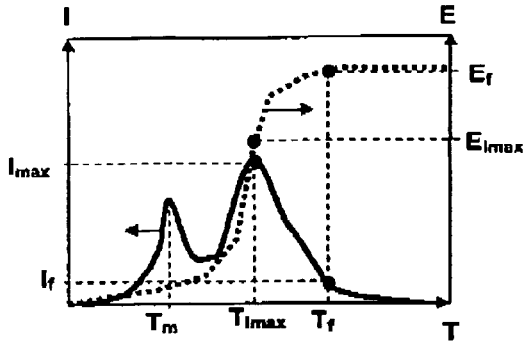
Fig.3-B – Prior Art
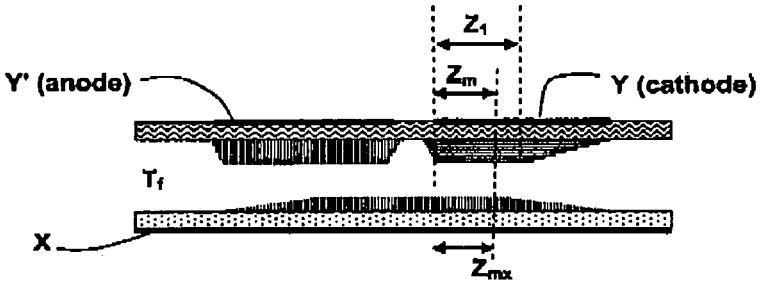
Fig.4 – Prior Art
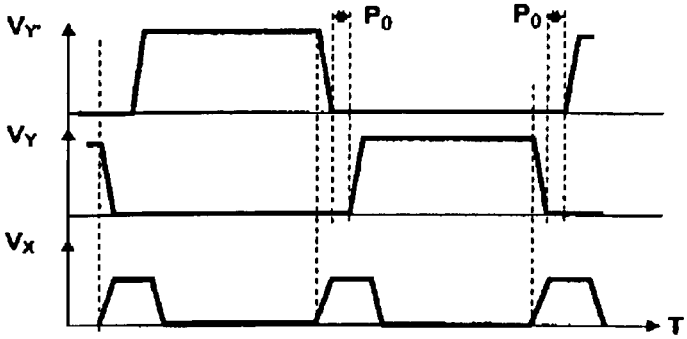
Fig. 5 – Prior Art

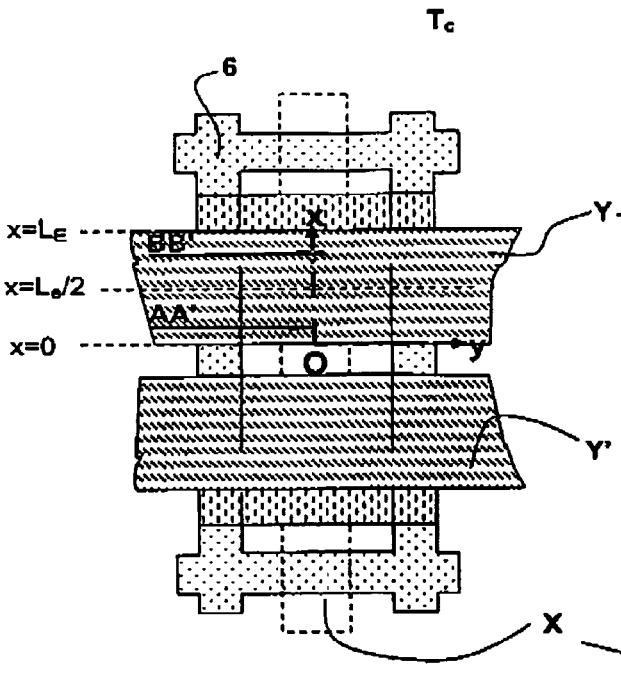
Fig.8-A
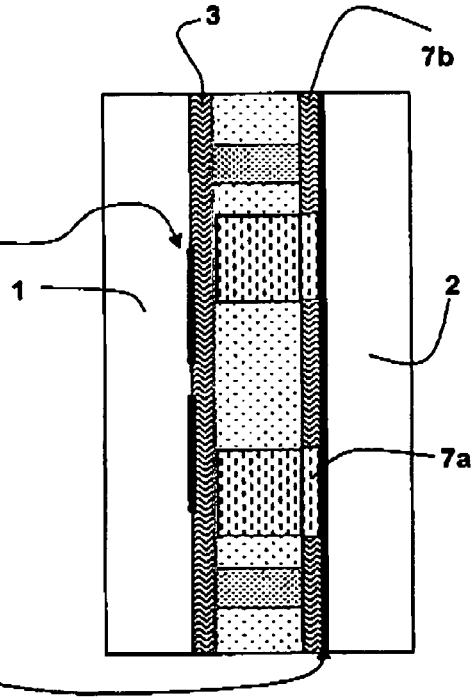
Fig.8-B
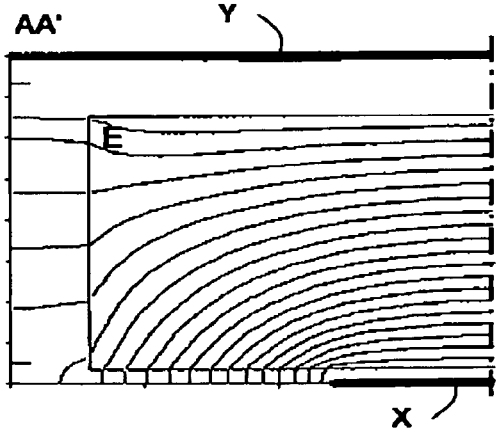
Fig.9-A
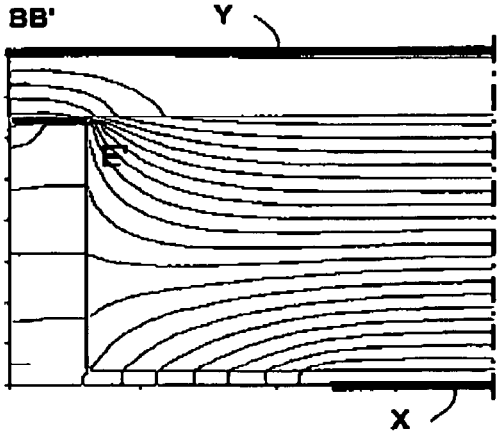
Fig.9-B

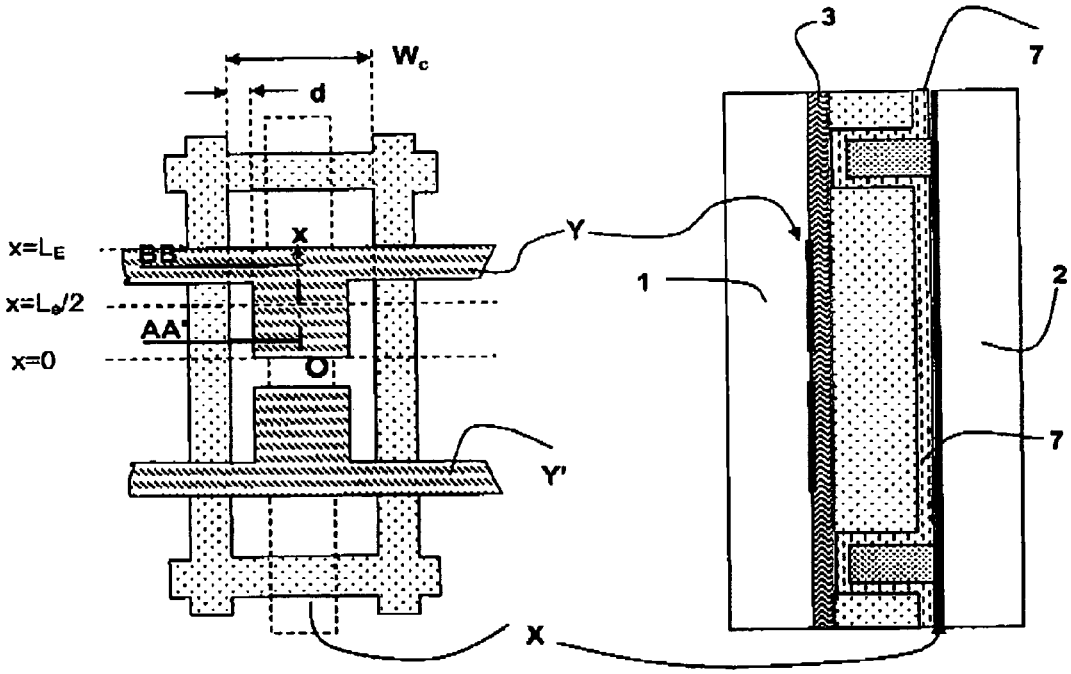
Fig.10-A
Fig.10-B
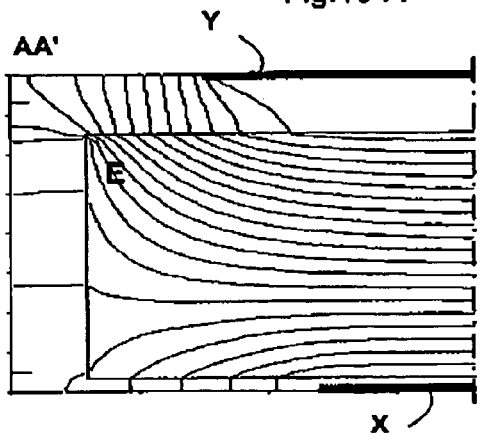
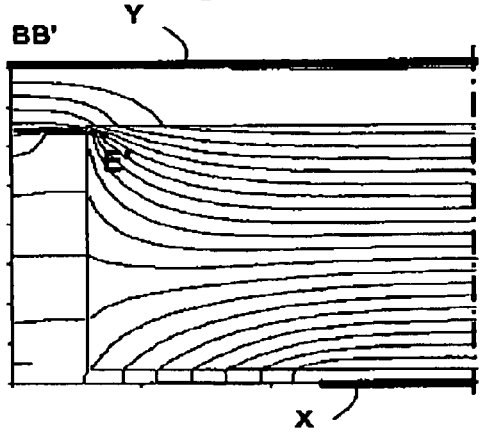
Fig.11-A
Fig.11-B

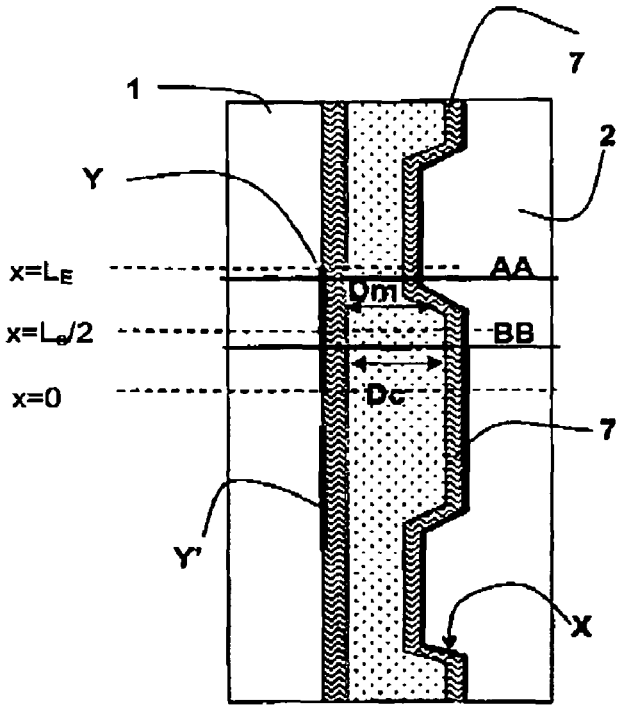
Fig. 12
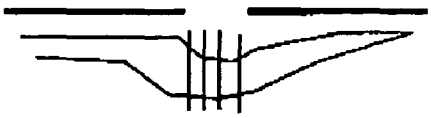
Fig.13-A – Prior Art
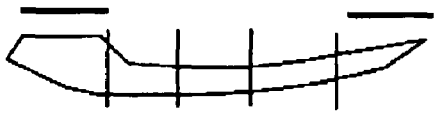
Fig.13-B – Prior Art
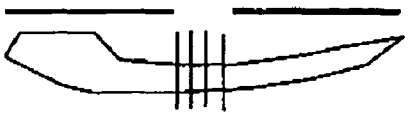
Fig.13-C
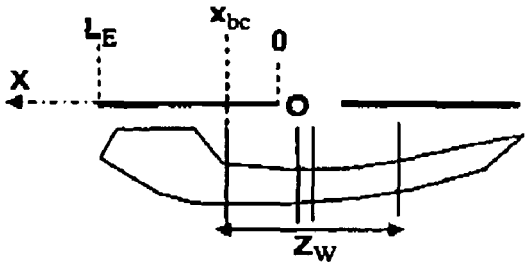
Fig.13-D

SMALL-GAP PLASMA DISPLAY PANEL WITH ELONGATE COPLANAR DISCHARGES

FIELD OF THE INVENTION

The invention is related generally to a plasma display panel, and more particularly to a plasma display panel with coplanar electrodes.

BACKGROUND OF THE RELATED ART

A plasma display panel of the prior art comprises, as shown in FIGS. 1A and 1B, a first plate 1, generally provided with at least a first and a second array of coplanar electrodes Y, Y', and a second plate 2 provided with an array of electrodes X, called address electrodes. The address electrodes form a two-dimensional set of elementary discharge regions, filled with a discharge gas, each positioned at the intersection of an address electrode X and a pair of electrodes of the first and the second array of coplanar electrodes.

In this type of display panel, it is possible to generate, in each elementary discharge region either what are called matrix discharges, when these take place between the address electrode and one of the two coplanar electrodes serving this region, or what are called coplanar discharges when these take place between the two coplanar electrodes serving this region.

The methods for driving a panel of this kind are suitable for displaying images divided into a succession of frames, in which each frame is itself divided into a succession of subframes in order to generate the various grey levels, where each subframe generally comprises an address phase followed by a sustain phase. During each address phase, a matrix discharge is generated in those discharge regions of the panel that have to be activated during the subframe, that is to say during the sustain phase that follows. During each sustain phase, a succession of voltage pulses is generated between the coplanar electrodes so as to cause display discharges only in those discharge regions that have been activated beforehand.

Thus, the matrix discharges are generally caused only during address phases, or phases other than the sustain phases, such as for example the reset phases. Documents EP 1 294 006 and U.S. Pat. No. 6,295,040 illustrate such image display devices, and also the article entitled "A new method to reduce addressing time in a large AC plasma display panel" in IEEE Transactions on Electron Devices, Vol. 48, No. 6, June 2001, pp. 1082-1096, which describes a plasma display panel structure enabling the duration of the address phases for each subframe to be shortened.

The electrodes of both the first and second array of coplanar electrodes of the plate 1 are generally directed so as to be mutually parallel. Each electrode Y of the first array is adjacent to an electrode Y' of the second array, is paired with it and is intended to serve a set of coplanar discharge regions, and vice versa for each electrode Y' of the second array.

The arrays of coplanar electrodes are coated with a dielectric layer 3 in order to provide a memory effect. The dielectric layer 3 itself being coated with a protective and secondary-electron-emitting layer 4, generally based on magnesia.

The adjacent elementary discharge regions, at least those that emit different colors, are generally bounded by horizontal barrier ribs 5 and/or vertical barrier ribs 6. These barrier ribs generally serve also as spacers between the plates.

The address electrodes are generally covered with a layer of dielectric material 7 in order to provide a memory effect.

The dielectric material 7 layer has a uniform thickness in that part of the plate 2 which forms the wall of the discharge region.

As shown in FIG. 1A, within each elementary discharge region, the area of the discharge region located plumb with each of the coplanar electrodes lying between x=0 and x=Le, can be subdivided into several regions along the direction of the OX axis perpendicular to the general direction of the coplanar electrodes. First, a conducting region $Z_a$, called the coplanar discharge ignition region, lying between X=0 and X=La, one of the boundaries of which forms an ignition edge, or internal edge, facing the other coplanar electrode of the same elementary discharge region. Second, a conducting region $Z_e$, called a coplanar discharge expansion region, lying between X=La and X=Le, located at the rear of the conducting ignition region opposite the other coplanar electrode; one of the boundaries of this expansion zone forms an end-of-expansion edge or external edge, opposite the ignition edge. Third, a conducting region $Z_m$, called a coplanar matrix discharge region, lying between X=Xm1 and X=Xm2, encroaching both on the coplanar discharge ignition region and on the coplanar discharge expansion region defined above, which includes at least one part of the region where the coplanar electrode in question crosses the address electrode in the discharge region.

In each discharge region or cell of the display panel, the address electrode therefore crosses two coplanar electrodes. In each of the two corresponding crossing regions, we may define on the coplanar electrode, a coplanar matrix discharge conducting region $Z_m$ and on the address electrode, a matrix discharge conducting region $Z_{mx}$.

The "gas height" in each cell of the display panel corresponds to the gap separating the two plates. The gas height is approximately constant in each cell, and therefore identical in the case of the two matrix discharge regions of each cell. The gas height in the matrix discharge region corresponds to the gap between the regions $Z_m$ and $Z_{mx}$ in this region.

An elementary discharge region or cell of the display panel therefore comprises at least two matrix discharge regions extending between the plates and a coplanar discharge region extending over the first plate at the coplanar electrodes and between them. Each set of elementary discharge regions served by one and the same pair of electrodes corresponds in general to a horizontal row of elementary discharge regions, cells or subpixels of the display panel. Each set of elementary discharge regions served by one and the same address electrode corresponds in general to a vertical column of elementary discharge regions, cells or subpixels.

The walls of the discharge regions are generally partly coated with phosphors sensitive to the ultraviolet radiation from the luminous discharges. Adjacent column discharge regions are provided with phosphors that emit different primary colors, so that the combination of these three adjacent elementary regions or subpixels in one and the same row forms a picture element or pixel.

The cell shown in FIGS. 1A and 1B is of rectangular shape (other cell geometries have been disclosed in the prior art). The largest dimension of this cell lies parallel to the address electrodes X, where Ox is the longitudinal axis of symmetry of this cell. In each elementary discharge region served by a pair of electrodes and forming a discharge cell, the portions of electrodes Y, Y' bounded by the vertical barrier ribs 6 separating the columns have a width $L_E$ measured parallel to the Ox axis. This electrode width $L_E$ is in this case constant over the entire width of the cell.

To display an image of a video sequence, a conventional exclusively coplanar-sustain drive method is used. By means of the array of address electrodes and of one of the arrays of coplanar electrodes, each row of the display is addressed in succession by depositing electrical charges in the dielectric layer region of each discharge region of this row that has been preselected, the corresponding subpixel of which has to be activated in order to display the image. Then, by applying series of sustain voltage pulses between the coplanar electrodes serving the regions that have just been addressed, series of sustain pulses are produced only in the regions charged beforehand, thereby activating the corresponding subpixels and allowing the image to be displayed.

SUMMARY OF THE INVENTION

One object of the invention is to combine a drive method in which the coplanar discharges are each initiated by matrix discharges with a plasma display panel having coplanar electrodes and a structure suitable for obtaining the highest luminous efficiencies with this display method.

For this purpose, the subject of the invention is an image display device having a plasma display panel including a first plate provided with at least two arrays of coplanar electrodes that are coated with a dielectric layer and a second plate provided with an array of electrodes called address electrodes that are coated with a dielectric layer, forming between them a two-dimensional set of elementary discharge regions corresponding to pixels or subpixels of the images to be displayed. The elementary discharge regions being filled with a discharge gas and each being positioned at the point where an address electrode crosses a pair or group of electrodes formed by an electrode of each coplanar array. Each elementary discharge region being subdivided into a coplanar discharge region, at least two matrix discharge regions and a drive means.

The coplanar discharge region including a portion of the space between the plates that is located above the coplanar electrodes traversing this elementary region and between these electrodes. Each of the coplanar electrodes extending over the width between an edge called the internal edge, facing another of the coplanar electrodes, and an edge called the external edge at the limit of the coplanar discharge region.

The at least two matrix discharge regions, each having a portion of the space between the plates that is located at the point where one of said coplanar electrodes crosses the address electrode traversing this elementary region. Each of the at least two matrix discharge regions being located closer to the external edge than the internal edge of the coplanar electrode with which this matrix discharge region is associated.

The drive means is for controlling the discharges in the panel. The discharges are designed to generate, during display phases called sustain phases, series of sustain voltage pulses between the electrodes of pairs or groups of coplanar electrodes so as to cause discharges in coplanar regions of the elementary discharge regions traversed by these coplanar electrodes.

Either of the drive means for controlling the discharges are also designed so that, during the sustain phases, the potential of the address electrodes is maintained at a value suitable for causing, before and/or at the start of each sustain pulse, a matrix discharge between the address electrodes and the electrodes of one of the coplanar arrays traversing said elementary discharge regions or the drive means for controlling the discharges are also designed to generate, before each sustain pulse, a matrix voltage pulse between the address electrodes and the electrodes of one of the coplanar arrays traversing the elementary discharge regions so as to cause a discharge in the matrix regions corresponding to the electrodes of said coplanar array.

In such a plasma display panel, each elementary discharge region is generally traversed by two coplanar electrodes, which then form a pair. The invention also covers the case of display panels in which each elementary discharge region is traversed by at least three coplanar electrodes, which then form a group of electrodes.

In the first embodiment, the matrix discharges arise "spontaneously", and initiate, each one, a coplanar discharge. The suitable value of the address electrode potential is preferably constant. This constant value is suitable for obtaining coplanar discharges and for initiating a matrix discharge before each coplanar discharge.

In the second embodiment, the matrix discharges are caused by a matrix voltage pulse and also initiate, each one, a coplanar discharge.

The luminous efficiency of the device according to the invention is improved even more by using coplanar voltage pulses whose rise time corresponds to a rate of voltage variation of between 0.2 V/ns and 1 V/ns.

The plasma display panel comprises a first plate, provided with at least two arrays of coplanar electrodes that are coated with a dielectric layer, and a second plate provided with an array of electrodes called address electrodes that are coated with a dielectric layer, forming between them a two-dimensional set of elementary discharge regions corresponding to pixels or subpixels of the images to be displayed. The elementary discharge regions being filled with a discharge gas and each being positioned at the point where an address electrode crosses a pair of electrodes formed by an electrode of each coplanar array. Each elementary discharge region is subdivided into at least two matrix discharge regions, each region comprising a portion of the space between the plates located at the point where one of the coplanar electrodes crosses the address electrode traversing this elementary region and a coplanar discharge region comprising a portion of the space between the plates that is located above the coplanar electrodes traversing this elementary region and between these electrodes.

According to the invention, each electrode of a coplanar array extends over its width between an edge called the internal edge, facing an electrode of the other coplanar array traversing the same elementary discharge regions, and an edge called the external edge at the boundary of the coplanar discharge regions of these elementary regions. In each elementary discharge region, each matrix discharge region is therefore located closer to the external edge than the internal edge of the coplanar electrode with which this matrix discharge region is associated.

Preferably, in each elementary discharge region, the geometry of the electrodes and/or the nature of the walls of this elementary region and/or the shape of these walls are designed to localize each matrix discharge region closer to the external edge than the internal edge of the coplanar electrode with which this matrix discharge region is associated.

The elementary discharge regions are generally separated by barrier ribs, which also serve as spacers between the plates. The second plate and the sides of the barrier ribs are generally coated with phosphor materials capable of emitting visible light when excited by the ultraviolet radiation emitted by the discharges. The coplanar electrodes are coated with a dielectric layer which itself is generally coated with a protective and secondary-electron-emitting layer. The address electrodes are also coated with a dielectric layer which may be a layer made of the same material as that of the barrier ribs and/or of the phosphor material.

The luminous efficiency of the device according to the invention is improved even more by using, in the discharge gas, a Xenon (Xe) concentration of between 3% and 20%.

Preferably, the gap separating the internal edges of the coplanar electrodes of each pair or each group is, in each coplanar discharge region, less than or equal to twice the average gap separating the two plates. This gap corresponds to the average gas height in the display panel. These "internal" edges correspond to the edges that face each other within one and the same discharge region.

The gap between the coplanar electrodes of one and the same pair may be substantially greater outside the coplanar discharge regions, especially if these electrodes are provided with indentations placed at the barrier ribs that separate the discharge regions of the display panel. Preferably, the gap separating the internal edges of the coplanar electrodes of each pair is less than or equal to 200 μm. In this way, the amplitude of the sustain pulses, which is necessary for obtaining the coplanar discharges, is advantageously limited, generally to between 100 and 200 V. It should be noted that although coplanar discharges of great length are obtained, a display panel with a small "gap" is used.

Preferably, on each row of elementary discharge regions, the dielectric layer covering the address electrodes on the second plate is subdivided into two types of regions. First, there are regions of high dielectric permittivity, each located facing the rear half of a coplanar electrode of this row, near the external edge of this electrode. Second, there are regions of low dielectric permittivity that are located between the high-permittivity regions. The average permittivity of the high-permittivity regions being at least three times greater than that of the low-permittivity regions.

It is possible to localize each matrix discharge region closer to the external edge than the internal edge of the coplanar electrode with which it is associated. Preferably each column of elementary discharge regions is separated from an adjacent column by a barrier rib. In each elementary discharge region, each coplanar electrode traversing this region is indented at the two barrier ribs defining this region as far as an indentation level located closer to the external edge than the internal edge of this coplanar electrode. In one embodiment, the edge referred to as the lateral edge of each indentation, which faces one or other of the barrier ribs, is separated from these barrier ribs by at least 50 μm. For this specific form of coplanar electrodes, it is possible to localize each matrix discharge region closer to the external edge than the internal edge of the coplanar electrode with which it is associated.

In another embodiment, in each elementary discharge region, the average gas height is lower at the rear halves of the coplanar electrodes than at the front halves of these electrodes. For this specific geometry of the elementary discharge regions, it is possible to localize each matrix discharge region closer to the external edge than the internal edge of the coplanar electrode with which it is associated. The external edge of the coplanar electrodes limits expansion of the coplanar discharges.

In the display devices of the prior art in which the sustain discharges are controlled without matrix discharges, it is the internal edge of the coplanar electrodes that serves as edge for initiating the coplanar discharges; here, whether in the case of display devices with spontaneous matrix discharges or induced matrix discharges, it is the matrix discharge that precedes and initiates each coplanar discharge on the cathode side that serves, as it were, as "initiating edge" for the coplanar discharges. Since, according to the invention, this "initiating edge" is very much set back from the internal edge of the coplanar electrode serving as cathode, that is to say according to the invention closer to the external edge than the internal edge, the coplanar discharge, right from its initiation, is advantageously very long.

Each image frame to be displayed is generally divided into subframes of various durations corresponding to various grey levels. The display of each subframe generally comprises, in succession, a reset phase, in which the elementary discharge regions are reset, an address phase, for the purpose of depositing charges only in the elementary regions to be activated in order to display the image subframe, and a sustain phase, during which a series of sustain pulses is applied over the duration of the subframe, the voltage of the sustain pulses being such as to induce coplanar discharges only in the elementary regions activated beforehand.

In the case of matrix discharges induced just before each sustain pulse, in which, in each elementary region, one electrode of one of the coplanar arrays serves as cathode, a voltage pulse called a "matrix" pulse is applied between this cathode and the address electrode traversing this region, which has an amplitude such as to induce a matrix discharge between this cathode and the address electrode serving as anode.

During a series of sustain pulses, each matrix pulse for initiating a coplanar discharge starts just before the start of the sustain pulse that generates this coplanar discharge. Preferably, the matrix pulse starts even before the end of the preceding sustain pulse.

Preferably, each matrix voltage pulse $P_M$ starts before the end of the sustain pulse $P'_S$ that precedes the discharge to be initiated. Preferably, the duration Ta separating the start of the voltage plateau of this matrix pulse $P_M$ from the end of the voltage plateau of said preceding sustain pulse $P'_S$ is between 0 and 500 ns. This advantageously avoids having the coplanar electrodes serving as cathodes and the address electrodes at the same potential, which would run the risk of self-erasing the charges stored on the dielectric layers and a loss of the "memory" effect intrinsic in the operation of plasma display panels. The start of the voltage plateau of each sustain pulse $P_S$, intended to supply a discharge $D_C$ to be initiated, starts so that the duration Tb separating the start of the voltage plateau of the corresponding matrix pulse $P_M$ from the instant when the light intensity of the coplanar discharge $D_C$ is a maximum is less than 1000 ns. In practice, beyond 1000 ns, the volume charges created in the gas by the matrix discharge induced by the matrix pulse $P_M$ are no longer sufficient to contribute to initiating the coplanar discharge $D_C$. The upper limit of 1000 ns corresponds to a discharge gas containing 4% Xenon (Xe). For higher Xe concentrations, the upper limit of Tb decreases.

The duration Tc separating the instant when the light intensity of the coplanar discharge $D_C$ is a maximum from the end of the voltage plateau of the corresponding matrix pulse $P_M$ is less than 1000 ns. The duration (Tb+Tc) of the matrix pulses $P_M$ is less than that of the sustain pulses. The duration (Tb+Tc) of the matrix pulses $P_M$ is not less than 100 ns. In practice, this is the minimum duration for obtaining a sufficient space charge density in the gas. Preferably, the potential difference between the coplanar electrodes between two sustain pulses has no intermediate voltage plateau, especially no zero voltage plateau.

Irrespective of whether the display device has spontaneous matrix discharges or induced matrix discharges, as soon as each coplanar discharge appears it "straddles" not only the coplanar inter-electrode region but also at least the front half of the coplanar electrode serving as cathode during this discharge, this front half being bounded by the internal edge of this electrode. In this way, each coplanar discharge has, as soon as it appears, a high expansion level, thereby providing a very high luminous efficiency.

It is therefore thanks to the positioning of the matrix discharge regions closer to the external edges of the coplanar electrodes than their internal edges that much greater improvements in the luminous efficiency of the display panels can be achieved than in the prior art.

Let Ox be the axis of symmetry of an elementary discharge region, this axis being perpendicular to the general direction of the coplanar electrodes. Let O be that point on this axis located on the internal edge of one of the coplanar electrodes, at the place where this internal edge is closest to the other coplanar electrode traversing the same region and let $x=L_E$ be the position of the external edge of this electrode along this axis Ox. Thus, according to the invention, the region in which the matrix discharge is capable of developing during application of matrix pulses between this coplanar electrode and the address electrode traversing this region is between the straight line $x=L_E/2$ and the straight line $x=L_E$. Thus, each matrix discharge region associated with a coplanar electrode is located in the rear half of this coplanar electrode, this rear half being bounded by the external edge of this electrode.

Preferably, in the display panel of this display device, for each elementary discharge region, and for each coplanar electrode traversing this region, the electrode area corresponding to the rear electrode half, which is bordered by its external edge, is smaller than the electrode area corresponding to the front electrode half, which is bordered by its internal edge. The matrix discharge regions can thus be positioned closer to the external edges than the internal edges of the coplanar electrodes.

BRIEF DESCRIPTION OF THE DRAWINGS

The invention will be more clearly understood on reading the description that follows, given by way of non-limiting example with reference to the appended figures in which:

FIGS. 1A and 1B, show a schematic view, from above and in section, of a cell of a plasma display panel of the prior art;

FIG. 2A shows the various instants of a discharge in the cell of FIGS. 1A and 1B, in the case in which no prior matrix discharge occurs;

FIG. 2B illustrates the variation in the intensity and in the expansion of this discharge;

FIG. 3A shows the various instants of a discharge in the cell of FIGS. 1A and 1B, including a prior matrix discharge that is positioned closer to the inner edge of the electrodes than the outer edge, as in the prior art; FIG. 3B illustrates the variation in the intensity and in the expansion of this discharge;

FIG. 4 illustrates the positioning of the matrix discharge regions in the cell of FIGS. 1A and 1B, in the case of the discharge of FIGS. 3A and 3B;

FIG. 5 illustrates the timing diagrams for coplanar pulses and matrix pulses of the prior art for obtaining the discharges of FIGS. 3A and 3B;

FIGS. 8A and 8B show a schematic view, from above and in cross section, of the second embodiment, described below, of a cell of a plasma display panel according to the invention;

FIGS. 9A and 9B show the electric field lines in the section AA' and the section BB' of the cell in FIGS. 8A and 8B, respectively;

FIGS. 10A and 10B show a schematic view, from above and in cross section, of one embodiment of a cell of a plasma display panel according to the invention;

FIGS. 11A and 11B show the electric field lines in the section AA' and the section BB' of the cell of FIGS. 10A and 10B, respectively;

FIG. 12 shows a schematic view, from above, of another embodiment of a cell of a plasma display panel according to the invention;

FIGS. 13A to 13D illustrate the coplanar discharges that are obtained in various types of plasma display cell: FIG. 13A, a small-gap cell with no prior matrix discharge of the prior art; FIG. 13B, a large-gap cell with prior matrix discharge of the prior art; FIG. 13C, a small-gap cell with prior matrix discharge according to the invention; and FIG. 13D, an improvement of the invention in which the electric field in the discharge is weak.

DETAILED DESCRIPTION

Figure 6A:
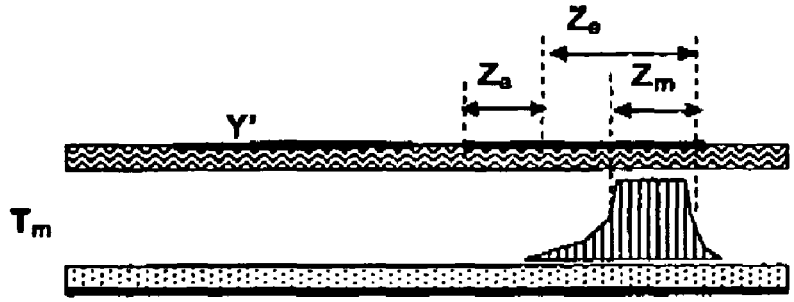
FIGS. 6A to 6D show the various instants of a discharge that includes a prior matrix discharge positioned closer to the external edge of the electrodes than the internal edge, in accordance with the invention.
Figure 6B:
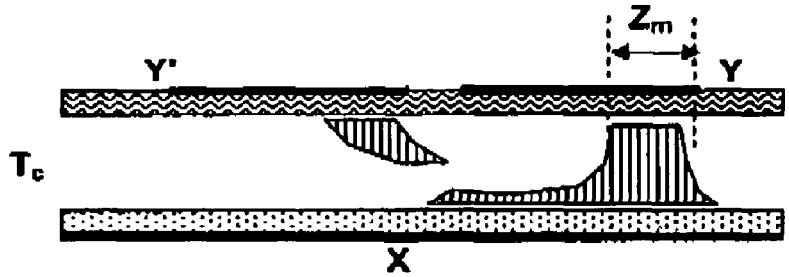
Figure 6C:
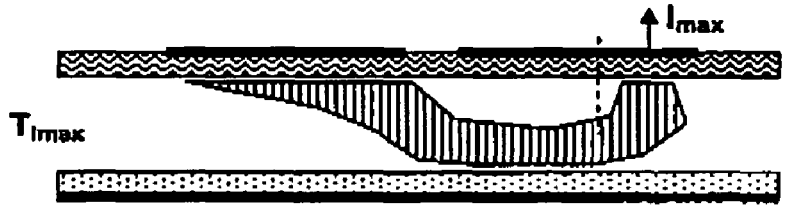
Figure 6D:
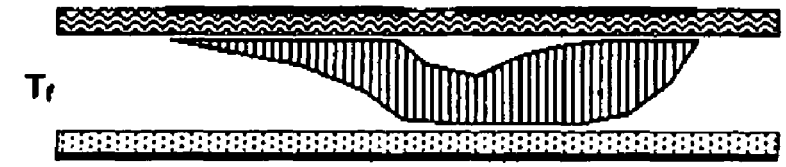

To simplify the description and to bring out the differences and advantages that the invention has over the prior art, identical references will be used for the elements that fulfil the same functions.

When a coplanar discharge plate is used in a plasma display panel, each coplanar sustain discharge arising between the electrodes of a coplanar pair, one serving as cathode and the other as anode, includes a coplanar ignition phase and a coplanar expansion phase. FIG. 2A shows the various ignition and expansion steps of such a coplanar discharge, in a schematic longitudinal section of a cell as described in FIG. 1A. FIG. 2B shows, as a function of the time T of this discharge, the schematic variation in the intensity of its electric current I (solid curve) and the variation in its spread (dotted curve) between the coplanar electrodes.

The discharge ignition voltage obviously depends on the electrical charges stored beforehand on the anode and the cathode in the vicinity of the ignition region, especially during the preceding sustain discharge in which the cathode was an anode, and vice versa. Before a discharge, positive charges are therefore stored on the anode and negative charges on the cathode—these stored charges create what is called a memory voltage. The gas ignition voltage corresponds to the sum of this memory voltage and of the voltage applied between the coplanar electrodes, that is to say the sustain voltage.

At the moment of ignition at time $T_a$, the electron avalanche in the discharge gas between the electrodes then creates a positive space charge that is concentrated around the cathode, to form what is called the cathode sheath. The plasma region called the positive pseudo-column located between the cathode sheath and the anode end of the discharge contains positive and negative charges in approximately identical proportions. This region is therefore current conducting and the electric field therein is low. In this positive pseudo-column region, the electron energy therefore remains low, which favours effective excitation of the discharge gas and consequently the emission of ultraviolet photons. At time $T_a$, when the discharge forms, the plasma density is low and the current I is almost zero. The spread of the discharge is very small, this discharge still essentially being confined between the opposed ignition edges of the two coplanar electrodes, as illustrated in the "$T_a$" part of FIG. 2A.

Immediately after ignition ($T>T_a$, but $T<<T_{Imax}$), the largest part of the electric field in the gas between the anode and the cathode therefore corresponds to the field within the cathode sheath. The impact of the ions, which are accelerated in the intense field of the cathode sheath, on the magnesia-based layer that coats the dielectric layer, results in considerable emission of secondary electrons near the cathode. Under the effect of this intense electron multiplication, the density of the conducting plasma between the coplanar conducting elements then greatly increases, in both ion density and electron density, thereby causing the cathode sheath to contract near the cathode and positioning this sheath at the point where the positive charges of the plasma are deposited on the portion of the dielectric surface covering the cathode. On the anode side, the electrons in the plasma, which are much more mobile than the ions, are deposited on that portion of the dielectric surface covering the anode, in order to neutralize, progressively from the front rearwards, the layer of positive "memory" charges stored beforehand. From the moment that all of this stored positive charge has been neutralized, that is to say from the time $T_{Imax}$ onwards, the potential between the anode and the cathode then starts to fall. The electric field in the cathode sheath has then reached a maximum, corresponding to the maximum contraction of the sheath, and the electric current between the electrodes is also a maximum with an intensity $I_{max}$. The contraction of the cathode sheath is accompanied by a substantial increase in the ion energy that is dissipated in the accelerating electric field between the cathode sheath and the magnesia surface, and this increase produces a substantial degradation by ion spraying of the magnesia surface. Referring to FIG. 2B, at time $T_{Imax}$ when the current is at maximum $I_{max}$, and therefore the energy deposited in the discharge is a maximum, the limited spreading of the discharge $E_{Imax}$ produces a small positive pseudo-column region and the energy efficiency of the discharge is therefore also low.

Before formation of the discharge, the distribution of the potential along the longitudinal axis Ox on the surface of the dielectric layer covering the cathode is uniform and therefore no transverse electric field for displacing the cathode sheath exists. The positive charge coming from the discharge is therefore deposited and therefore progressively builds up in the ignition region $Z_a$ of the cathode, still without there being any displacement of the sheath. The ignition region $Z_a$ therefore corresponds to an ion accumulation region at the start of, the discharge throughout the period during which the cathode sheath of this discharge is not displaced, that is to say for $T<T_{Imax}$. The ion bombardment of the cathode is therefore concentrated on a small area of the magnesia layer covering this cathode and induces strong local sputtering of this layer. Under the effect of the positive charges that build up on the dielectric surface portion located beneath the cathode sheath, a "transverse" field is then created, on the one hand under the effect of these positive charges that have just been deposited on the cathode and, on the other hand, under the combined effect of the negative charges pre-existing on this cathode (for example owing to the preceding discharge) and of the potential applied to this cathode (sustain voltage pulse). Above a transverse field threshold, which corresponds to a charge density threshold as regards the positive charges that have accumulated on the cathode near this sheath, this transverse field causes displacement of the cathode sheath further and further away from the ignition region as the ionic charges progressively build up on the dielectric surface portion that covers the cathode. It is this displacement that causes the plasma discharge to expand on the cathode side. The cathode sheath is positioned at the point where the ions in the plasma are deposited, at the boundary of the expansion region. During the coplanar discharge, the cathode sheath moves towards the cathode edge on the opposite side from the ignition edge. The expansion region $Z_e$ therefore corresponds to the region swept by the displacement of the discharge cathode sheath, corresponding to the discharge phase between $T_{Imax}$ and $T_f$, the instant discharge spreading stops.

Referring to FIG. 2B, the spreading of the discharge over the surface of the dielectric layer, between time $T_{Imax}$ and $T_f$, makes it possible to extend the positive pseudo-column region of the discharge, and therefore to increase the electrical energy part of this discharge which is dissipated in order to excite the gas in the cell, and therefore to improve the ultraviolet photon production efficiency of the discharge. In respect of the cell structure described in FIGS. 1A, 1B and the method of driving this cell corresponding to FIGS. 2A, 2B, the amount of energy dissipated at time $T_f$, which corresponds to the electrical current $I_f$ at this instant, remains low. As regards all of the energy dissipated during a discharge produced here by an exclusively coplanar sustain mechanism, only a small part of this energy is therefore dissipated during the instants when this discharge is sufficiently extended to have a high ultraviolet photon production efficiency. In general, the luminous efficiency therefore remains low.

One means of improving the luminous efficiency therefore consists in dissipating the maximum amount of energy in the discharge when the latter is at its optimum expansion point, that is to say approaching the time $T_{Imax}$ corresponding to the maximum amount of energy dissipated in the discharge and the time $T_f$ when the discharge reaches the spreading limit $E_f$, or else to minimize the spreading $E_f/E_{Imax}$ ratio. The publication with the reference 25.4 by K. Yamamoto et al., presented at the annual worldwide meeting of the SID in 2002 (ISSN/0002-0966X/02/3302-0856), thus proposes a solution for improving the luminous efficiency of plasma display panels. FIG. 3A shows the spreading of the discharge and FIG. 3B describes this spread E and the intensity I of the current in this discharge as a function of the time T, in the case in which the display panel is driven according to the principle described in that publication.

During the sustain drive phases of the display panel, such as those described in that application, in each cell, a zero voltage is applied to the coplanar cathode, a positive voltage is applied to the coplanar anode and, in this case, a zero or at least positive constant voltage less than that of the anode is applied to the address electrode. The initial memory charges coming from the preceding discharge in this cell, which are deposited on the dielectric layer from one or other of the plates, are negative on the coplanar cathode, positive on the coplanar anode, and generally positive on the address electrode since the latter was connected to a zero potential throughout the end of the sustain pulse of the preceding discharge. If the DC potential applied to the address electrode is not zero, the corresponding memory charge is adapted so that, at the end of the discharge, the potential on the surface of the dielectric layer covering the conducting address element is close to the median potential equidistant from the potential applied to the anode and from the potential applied to the coplanar cathode. This therefore results in a non-zero electric field between the address electrode and the coplanar anode in the matrix discharge region located between these two electrodes. The memory charges are therefore not deposited uniformly on the conducting address element. The density of this charge deposition is a maximum in the matrix regions $Z_{mx}$ of the address electrode, these generally being located facing the coplanar ignition regions of each of the coplanar electrodes on the first plate 1, as shown in FIG. 4. As this figure illustrates, the density of this deposition is approximately constant within the regions $Z_{mx}$ and progressively decreases on moving away from these regions, away from the ignition edges (only the region $Z_{mx}$ facing the cathode has been indicated in FIG. 4).

As illustrated in FIG. 1A, the longitudinal axis Ox of symmetry of the cell also corresponds here to the axis of symmetry of the address electrode. On the surface of the dielectric layer that covers this electrode and is in contact with the gas in the cell, there is therefore, as illustrated in FIG. 4, an approximately uniform potential in each of the two matrix discharge regions, and then a potential that decreases along the Ox axis while moving away from the center of the cell and from these regions.

As illustrated in FIG. 4, the negative memory charge deposited on the dielectric layer region covering the coplanar cathode Y is itself relatively uniform over at least the first half Z1 of this region, and therefore generates a relatively uniform negative potential (with a maximum in absolute value) over this entire region Z1.

Each of the two matrix discharge regions of a cell is defined as a region comprising the entire gas height between the plates and within which the electric field is approximately uniform between the two plates, and is a maximum in order to allow ignition of a matrix discharge specifically in these regions when a matrix pulse is applied. Thus, the matrix discharge region located on the cathode side in FIG. 4 is bounded by the coplanar region $Z_m$ on the coplanar plate and by the matrix region $Z_{mx}$ on the plate bearing the address electrodes. It should be noted here that $Z_m$ lies within Z1. The other matrix discharge region, located on the anode side, is defined in a similar manner.

To obtain a matrix discharge in a matrix discharge region, it is necessary to create an electric field greater than the gas breakdown field. This breakdown field depends on the nature of the gas and its pressure, and also on the distance between the two plates. For conventional coplanar sustain voltage pulses, that is to say those having an amplitude of 200 V or less, and for a distance between the plates of 100 μm or more (equal to the gas "height"), it is not possible in practice to achieve the breakdown field using only the potential difference generated by the memory charges stored on the dielectric layer of the plate 1 above the cathode and on the dielectric layer of the plate 2 above the address electrode. The above-mentioned publication proposes to achieve this breakdown field by superposing, during the sustain phases, a positive matrix voltage pulse on the address electrode, at each positive voltage pulse applied to the anode, as shown in FIG. 5, in which Y and Y' act alternately as anode. The frequency of the matrix sustain pulses $V_X$ is then twice the frequency of the coplanar sustain pulses $V_Y$, $V_{Y'}$ that are applied alternately to the two electrodes of each coplanar pair.

By applying this matrix pulse $V_x$ before applying a positive coplanar pulse $V_Y$ or $V_{Y'}$, as illustrated in FIG. 5, the electric field in the gas space separating the plate 1 from the plate 2, between the coplanar cathode and the address electrode of each discharge region, becomes greater than the gas breakdown field and a matrix discharge forms in the matrix discharge regions. Once the matrix discharge has been initiated, as illustrated for example in FIG. 3A at time $T_m$, a memory charge of opposite sign is deposited on each of the dielectric surface regions $Z_m$, $Z_{mx}$ lying in the matrix discharge region located on the cathode side (see FIG. 4), the effect of which is to increase the algebraic surface potential (which is initially strongly negative because this surface acted as anode to the preceding pulse) in the coplanar region $Z_m$. As illustrated in FIG. 3A, there are then two different potential regions on the dielectric surface covering the cathode, namely a first potential $V_{zm}$ in the coplanar matrix discharge region $Z_m$ and a second potential $V_{ze}$ in the coplanar discharge expansion region $Z_e$, giving the algebraic inequality $V_{ze}<V_z$. The electric field in the gas is therefore reduced in the coplanar ignition region and the coplanar discharge cannot in theory be initiated.

However, if the coplanar pulse is applied sufficiently rapidly, that is to say in practice less than 1000 ns after the matrix discharge emission maximum according to our determinations, it has been found that the volume charges created by the matrix discharge reduce the gas breakdown field and could on the contrary facilitate initiation of the coplanar discharge between the two coplanar electrodes Y, Y' of the cell. This is because the region of lowest potential of the dielectric surface that covers these coplanar electrodes is no longer, as in the previous example, located in the usual coplanar initiation region near the internal edge of the cathode, between X=0 and $X=L_a$, but is on the contrary located set back from this internal edge that served for the initiation in the previous example. Consequently, the ions produced in the plasma immediately move beyond the coplanar ignition zone $Z_a$ of the prior art until coming level with the coplanar expansion region of the cathode $Z_e$, at the point where the surface potential is lowest and equal to $V_{ze}$, that is to say beyond the region $Z_m$. The coplanar discharge then starts far from the internal edge of the cathode, for example at the rear half of the cathode (which is bounded by the external edge) and, as in the previous example, joins the internal edge of the coplanar anode. The coplanar discharge is then much longer at initiation, compared with the example described above. As FIG. 3A illustrates at time $T_{Imax}$, the electrons in the discharge then spread out, as in the case described above, as far as the external edge of the anode so that, when they reach this external edge, the current $I_{max}$ dissipated in the discharge passes through a discharge region that has a spread $E_{Imax}$ greater than that of the previous case illustrated in FIG. 2A. The spread $E_f/E_{Imax}$ ratio is therefore minimized, dissipating more energy in the discharge when the latter is extended and thus the luminous efficiency is improved. On the other hand, the increase in discharge spread by this method is limited to about half the distance that separates the internal edge from the external edge of the cathode, so that it is not possible, in practice, to achieve an increase in luminous efficiency of more than 30%.

Another drawback of this method described in the Yamamoto et al. document mentioned above lies in the difficulty of generating a matrix discharge in priority over a coplanar discharge, so that this matrix discharge is indeed an initiating discharge. This constraint means in practice that a voltage plateau has to be added between two sustain pulses (especially a zero plateau as illustrated by the reference $P_0$ in FIG. 5), so as to force a matrix discharge to be produced before the conditions for producing a coplanar discharge are also fulfilled. If the coplanar discharge appeared before the matrix discharge, no increase in efficiency could be obtained.

It may therefore be seen, from this detailed description of the both coplanar and matrix drive mode according to the Yamamoto et al. publication, that the key for improving the luminous efficiency of plasma display panels lies in inverting the distribution of the energy dissipated during formation of the discharges, so as to dissipate the greatest amount of energy during the high efficiency period of the discharge, for example so that the $E_f/E_{Imax}$ ratio is a minimum.

The invention proposes to adapt the structure of the discharge regions and the signals applied to the electrodes serving these regions so as to generate the initiating matrix discharges as far away as possible from the internal edges of the coplanar electrodes, and preferably near the external edge of these electrodes (when they act as cathode) and, as soon as the coplanar discharges have been initiated, to make them extend very rapidly over the entire dielectric surface covering them, while still limiting the coplanar sustain voltage.

For this purpose, the invention proposes to increase the avalanche gain of the initiating matrix discharge by suitable means, so that the matrix discharge regions lie as far away as possible from the internal edges of the coplanar electrodes, preferably near the external edge of these electrodes.

Figure 7:
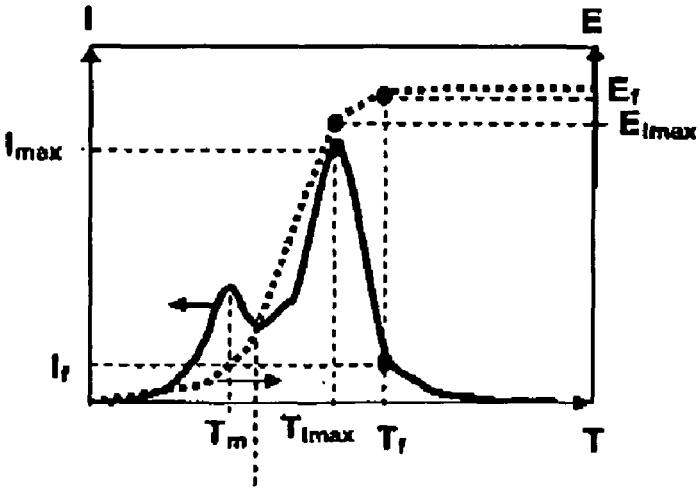
FIG. 7 illustrates the variation in the intensity and in the expansion of the discharge of FIGS. 6A to 6D.

The invention will be more clearly understood on studying FIGS. 6A, 6B, 6C, 6D. These figures show the variation over time of a discharge in a discharge region according to the invention, at the times $T_m$, $T_c$, $T_{Imax}$, $T_f$, which are themselves referenced and defined in FIG. 7 that illustrates the variation in the total discharge current as a function of time. At time $T_m$ in FIG. 6A, an initiating matrix discharge is forced between the electrode X acting as anode and the electrode Y acting as cathode, between the region $Z_{mx}$ lying above the conducting element X and the region $Z_m$ lying opposite the second half of the conducting coplanar element Y acting as cathode, by a local increase in the avalanche gain in this portion of the discharge region, for example according to the embodiments described below. When the initiating matrix discharge takes place predominantly in the second half of the coplanar cathode, the discharge spreads substantially along the conducting address element X, towards the coplanar anode, owing to the mobility of the electrons in the transverse field created by the potential difference between the positive charges initially stored on the dielectric surface of the plate 2 and the deposition of negative charges coming from the matrix discharge. Because the avalanche gain is chosen to be greater in the matrix discharge region $Z_m$ located here in the coplanar discharge expansion region $Z_e$, the avalanche gain is therefore lower in the coplanar ignition region $Z_a$. The coplanar discharge is therefore initiated naturally, with a slight time shift relative to the initiation matrix discharge and starts only at the time $T_c$ after the time $T_m$ of the matrix discharge. The two discharges join up and form one and the same highly extended discharge between the internal edge of the anode Y' and a region close to the external edge of the cathode Y. Next, the discharge spreads further, as far as the external edge of the anode Y', and the current maximum $I_{max}$ is reached when the electrons being deposited reach this external edge. The current maximum is therefore reached here when the discharge is already spread between the two external edges of the coplanar electrodes, that is to say when the discharge efficiency is a maximum. Thanks to the invention, the ratio of the spreads $E_f/E_{Imax}$ is thus very considerably minimized and the luminous efficiency is improved by more than 60%, proportionally greater than in the case of the prior art.

For proper operation of the invention, it is therefore necessary to combine the following conditions. A matrix discharge in priority over a coplanar discharge must be favoured, so that the matrix discharge is a discharge for initiating and rapidly extending the coplanar discharge, while still maintaining coplanar voltage pulses of sufficiently low amplitude. The initiating matrix discharges must be positioned as close as possible to the external edges of the coplanar electrodes, so as to obtain coplanar discharges that are as long as possible right from initiation. A sufficiently small gap must be maintained between the coplanar electrodes in order to be able to initiate the coplanar discharges with voltage pulses of sufficiently low amplitude. The sustain voltage of the display panel then remains advantageously low. This aspect distinguishes the invention from other documents of the prior art that describe "large gap" coplanar display panels with matrix initiation.

According to one embodiment of the invention, the features of which rely essentially on the geometry of the coplanar electrodes, for each cell and for each coplanar electrode, the coplanar electrode area located in the front half between the straight line x=0 and the straight line $x=L_E/2$ is reduced relative to the coplanar electrode area located in the rear half between the straight line $x=L_E/2$ and the straight line $x=L_E$, so as to significantly increase the cathode area and therefore the avalanche gain in the rear half of each coplanar electrode. Thus, it is possible to position the matrix discharge regions closer to the external edges than the internal edges of the coplanar electrodes. This geometrical definition means that the electrode area corresponding to the rear electrode half that is bordered by its external edge is smaller than the electrode area corresponding to the front electrode half that is bordered by its internal edge.

This reduction in area in the front half of the coplanar electrodes may be obtained by recesses or indentations made in these electrodes. Document U.S. Pat. No. 6,333,599 illustrates many examples of such possible forms of coplanar electrodes, which provide, in each cell, a larger area near their external edge than near their internal edge.

Preferably, in each cell, the coplanar electrode area lying between the straight line x=0 and the straight line $x=L_E/2$ is at most equal to half the coplanar electrode area lying between the straight line $x=L_E/2$ and the straight line $x=L_E$. It is thus possible to position the initiating matrix discharges closer to the external edges than the internal edges of the coplanar electrodes.

Figure 14:
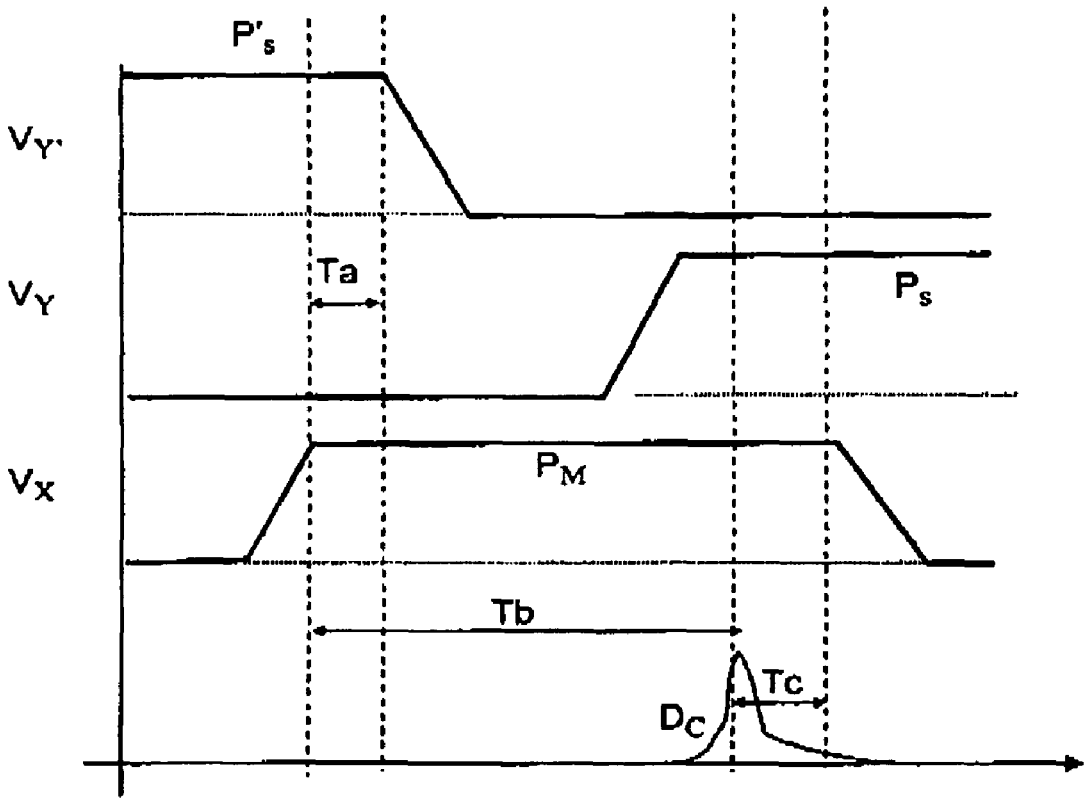
FIG. 14 illustrates an example of timing diagrams for coplanar pulses and matrix pulses in order to obtain discharges according to the invention, as shown in FIGS. 6A to 6D.

According to the invention, to achieve a large increase in luminous efficiency during the sustain phases, as illustrated in FIG. 5, a positive matrix voltage pulse is applied, in each cell and just before each sustain pulse, between the address electrode and the coplanar electrode serving as cathode. Preferably, as illustrated in FIG. 14, the matrix voltage pulse starts at most 500 ns before the end of the plateau of the voltage pulse applied beforehand to the cathode. Therefore $0<Ta<500$ ns. The duration of the plateau of this matrix pulse is greater than 100 ns but less than the duration of the plateau of the sustain pulse. This matrix pulse terminates at most 1000 ns after the maximum luminous intensity of the coplanar discharge generated by the sustain pulse. Therefore $Tc<1000$ ns.

Preferably, the amplitude of the matrix pulses is between about 50 V and 100 V. Thus, the initiation of each coplanar discharge is accompanied by a very short matrix discharge which, thanks to the particular structure of the cells, allows the luminous efficiency to be very greatly increased.

Furthermore, it is possible, in order to favor even more the positioning of the initiating matrix discharges closer to the external edges than the internal edges of the coplanar electrodes, to reduce the thickness and/or increase the dielectric constant of the dielectric layer in the rear half of these electrodes.

According to another embodiment of the invention described below with reference to FIG. 8, the features of which essentially depend on the nature of the walls of the cells, the dielectric layer 7 covering the address electrodes on the plate 2 is subdivided, in each row of cells, into two types of regions. Regions 7*a* of high dielectric permittivity, each located facing the rear half of a coplanar electrode of this row, near the external edge of this electrode. Regions 7*b* of low dielectric permittivity located between the high-permittivity regions.

Thus, the length of each high-permittivity region, measured along the Ox axis between the straight line $x=L_E/2$ and the straight line $x=L_E$, is less than or equal to $L_E/2$. This length is preferably greater than 50 μm and the dielectric permittivity of these regions is preferably, and on average, more than three times the dielectric permittivity of the low-permittivity regions.

The thickness of the dielectric layer 7 is generally between 5 and 20 μm. These regions 7*a* of high dielectric permittivity may be continuous, extending over the entire width of the display panel, or discontinuous, being located only in the cells of the display panel.

According to a first variant of this embodiment, and with reference to FIGS. 8A and 8B, the barrier ribs separating the columns are subdivided into two types of regions. Regions of high dielectric permittivity, each facing the rear half of a coplanar electrode, near the external edge of this electrode. Regions of low dielectric permittivity lying between the high-permittivity regions.

Thus, the length of each high-permittivity region, measured in the direction of the Ox axis between the straight line $x=L_E/2$ and the straight line $x=L_E$, is less than or equal to $L_E/2$. This length is preferably greater than 50 μm and the dielectric permittivity of these regions is preferably, and on average, greater than three times the dielectric permittivity of the low-permittivity regions of these barrier ribs separating the columns. Preferably, these high-permittivity regions extend over the entire height of the barrier ribs.

According to a second variant of this embodiment, the regions of high dielectric permittivity of the dielectric layer 7 are replaced with regions whose surface in contact with the discharge gas has a high photoemissive efficiency, that is to say a surface capable of emitting secondary electrons when it is excited by photons.

FIG. 9A shows the measured equipotential electric field lines in the cross section AA' of FIG. 8A in a portion of the elementary discharge region which is located in the front half of the coplanar electrode Y and is not a region of high dielectric permittivity. In this portion of the discharge region, the electric field between the address electrode X and the coplanar electrode Y acting as cathode remains low in the gas space identified as E in the figure, which is close to the top of the cell-separating barrier rib, and does not allow a matrix discharge to be initiated in this space, either during a sustain pulse or between these pulses.

FIG. 9B shows the potential lines in the cross section BB' of FIG. 8A lying in a portion of the discharge region which is located in the rear half of the coplanar electrode Y and has a region of high dielectric permittivity. In this portion of the discharge region, as illustrated in the figure, the electric field between the between the address electrode X and the coplanar electrode Y acting as cathode in the gas space identified by E' in the figure is much higher than previously, since the region of high dielectric permittivity takes the potential of the address electrode X back to close to the coplanar electrode Y. In this region, at the end of each sustain pulse where the electrode Y was the anode and when the electrode Y becomes the cathode, the electric field in the gas space identified by E' exceeds the matrix breakdown threshold, even in the absence of a matrix pulse, and a matrix discharge therefore arises in the space E'. Unlike the first embodiment, it is no longer necessary to apply a matrix pulse prior to the initiation of the new sustain pulse. Without departing from the invention, it is nevertheless possible to apply a matrix pulse under the same conditions as in the first embodiment.

Thanks to the properties of the walls of the discharge regions specific to this second embodiment, it is thus possible to position the initiating matrix discharges closer to the external edges than the internal edges of the coplanar electrodes, which significantly increases the luminous efficiency.

In the abovementioned variant in which the dielectric layer includes regions that are highly secondary-electron emissive, the discharge gain is increased in these regions by the creation, over the height of gas between the plates, and therefore along the matrix discharge path, of photoelectrons representing as many additional primary charges, generally created from photons emitted by the post discharge of the previous sustain pulse or from photons emitted from the onset of avalanche of the current discharge. In the portions of elementary discharge regions not having highly photoemissive regions, the photons are not converted into additional photoelectrons and the discharge gain is smaller.

According to a third embodiment of the invention, with reference to FIGS. 10A and 10B, the coplanar electrodes, in each discharge region, are indented between the straight line $x=0$ up to at least the straight line $x=L_E/2$, level with each barrier rib 6 separating the columns. In each cell of the display panel, these indentations provide, in the outline of each coplanar electrode, edges called lateral edges that face the walls of the column-separating barrier ribs. According to the invention, the distance d between these lateral edges and these walls is at least 50 μm. Preferably, the dielectric layer 7 that coats the address electrodes has a high dielectric permittivity, preferably equal to 30 or higher.

Thanks to this cell geometry and this electrode geometry, it is possible to position the initiating matrix discharges closer to the external edges than the internal edges of the coplanar electrodes, which significantly increases the luminous efficiency.

FIG. 11A shows the potential lines in the cross section AA' of FIG. 10A, for a portion of the elementary discharge region in which the electrode Y acting as cathode has, between opposed lateral edges of one and the same indentation, a non-zero width that is smaller by an amount 2×d than the width $W_C$ of the cell, so that, in the space identified by E close to the column-separating barrier, there is no coplanar electrode Y. In this case, the electric field in this space identified by E is low so that a matrix discharge will not be initiated in this region, that is to say between 0 and $L_E/2$.

FIG. 11B shows the potential lines in the cross section BB' of FIG. 10A, for a portion of the discharge region in which the electrode Y acting as cathode does not have an indentation, that is to say in the rear half of the coplanar electrode. In this portion of the discharge region, the electric field between the address electrode X and the conducting coplanar element Y acting as cathode is much higher than previously, especially in the space E' close to the column-separating barrier rib because of the presence of the electrode Y in this space. In this region, at the end of each sustain pulse where the electrode Y was the anode and when the electrode Y becomes the cathode, the electric field in the gas space identified by E' exceeds the matrix discharge threshold, even in the absence of a matrix pulse, and a matrix discharge therefore arises in the space E'. Unlike the first embodiment, it is no longer necessary to apply a matrix pulse prior to the initiation of the new sustain pulse. Without departing from the invention, it is nevertheless possible to apply a matrix pulse under the same conditions as in the first embodiment.

Thus, it is possible to position the initiating matrix discharges closer to the external edges at $x=L_E$ than the internal edges at $x=0$ of the coplanar electrodes.

According to a fourth embodiment of the invention, the features of which rely essentially on the geometry of the cells, the average gas height, in each elementary discharge region, is smaller at the rear halves of the coplanar electrodes than at the front halves of these electrodes.

FIG. 12 illustrates an example of this embodiment. Let $D_c$ be the gas height in the gas space between x=0 and $x=L_E/2$, in the front half of the coplanar electrodes. Let $D_m$ be the average gas height in the gas space lying between $x=L_E/2$ and $x=L_E$, in the rear half of the coplanar electrodes. According to the invention, $D_m<D_c$. Preferably, $D_C>100$ μm and 40 μm$<D_m<$80 μm.

Thanks to this cell geometry, it is possible to position the initiating matrix discharges closer to the external edges of the coplanar electrodes than their internal edges. Here again, unlike the first embodiment, it is unnecessary to apply matrix pulses prior to the coplanar pulses.

In general, the reduction in the gap between the coplanar electrodes and the address electrodes in certain regions of the cells is accompanied, for fabrication process reasons, by a reduction in the gap between the side walls of the cells constituting the barrier ribs of the discharge region.

FIGS. 13A to 13D show very schematically the various types of coplanar sustain discharges that it is possible to obtain with the various types of coplanar display panels, the vertical lines representing schematically the equipotential lines between the coplanar electrodes in these discharges. FIG. 13A shows a conventional "small gap" coplanar display panel in which the term "conventional" means that the display panel has none of the specific features of the embodiments 1 to 4 that have just been described. The term "gap" denotes the distance separating the internal edges of the coplanar electrodes and the term "small gap" means in practice a distance of less than about 100 μm. In this case, the luminous efficiency is mediocre and the electric field within the discharges is high (equipotential lines very close together in the figure).

FIG. 13B shows a coplanar display panel with matrix initiation of the coplanar discharges of the prior art, which has here a large gap of substantially greater than 100 μm, generally around 500 μm. The drawback of such a structure is that it requires sustain voltage pulses of high amplitude, and therefore relatively expensive power electronics.

FIG. 13C shows a small-gap coplanar display panel with matrix initiation corresponding to the embodiments 1 to 4 that have just been described. The small gap advantageously makes it possible to use sustain voltage pulses of relatively low amplitude. However, it may be seen that the electric field within the discharges is high (equipotential lines very close together in the figure).

FIG. 13D shows schematically an improvement of the invention based on small-gap coplanar display panels with matrix initiation that has the advantage of a low electric field within the discharges (equipotential lines relatively far apart in the figure).

This improvement leads to a fifth embodiment of the invention, which, apart from the features of any one of the embodiments 1 to 4, also has the following features.

According to this embodiment, each discharge region comprises two coplanar electrode elements having a common axis of longitudinal symmetry Ox, each element being connected to an electrode Y, Y' of a coplanar pair and, for each electrode element of each discharge region. Since the point Q on the Ox axis lies on the internal edge of said electrode element facing the other electrode element of said discharge region and since the Ox axis is directed along the direction of the external edge delimiting said element on the opposite side from said internal edge and positioned at $x=L_E$ on the Ox axis, the shape of said electrode element, the thickness of said dielectric layer and the composition of said layer are tailored so that there exists an interval $[0, x_{bc}]$ of values of x such that $x_b>0.25L_E$, and such that the surface potential V(x) increases as a function of x in a continuous or discontinuous manner, without a decreasing part, from a value $V_O$ to a higher value $V_{bc}$ within said interval $[0, x_{bc}]$ when a constant potential difference is applied between the two coplanar electrodes serving the said discharge region, having a sign suitable for said electrode element to act as cathode.

Preferably, defining the normed surface potential $V_{norm}(x)$ as the ratio of the surface potential V(x) at a point x on the dielectric layer for the electrode element in question to the maximum potential $V_{o\text{-}max}$ that would be obtained along the Ox axis for an electrode element extending beyond the lateral limits of the discharge region, the normed surface potential $V_{norm}(x)$ increasing from a value $V_{n\text{-}0}=V_0/V_{o\text{-}max}$ at the start x=0 of said interval to a value $V_{n\text{-}bc}=V_{bc}/V_{o\text{-}max}$ at the end $x=x_{bc}$ of said interval, then:

$$V_{n\text{-}bc}>V_{n\text{-}0},\ V_{n\text{-}0}>0.9 \text{ and } (V_{n\text{-}bc}-V_{n\text{-}0})<0.1.$$

Whatever $x_1$ and $x_2$ chosen between x=0 and $x=x_{bc}$ such that $x_2-x_1=10$ μm, it is preferably to have $V_{norm}(x')-V_{norm}(x)>0.001$. This thus ensures that there is a minimum electric potential gradient within the entire interval $[0, x_{bc}]$.

The interval $[0, x_{bc}]$ with a width of greater than $0.25L_E$ makes it possible to spread out and separate the equipotential curves, as illustrated in FIG. 13-D up to the line $x=x_{bc}$. Thus, a much lower electric field is obtained within the coplanar discharges than in the embodiments 1 to 4 described above. Thus, a region of low electric field $Z_W$ is created on the surface of the dielectric layer 3 covering the coplanar electrodes between the line $x=x_{bc}$ of this electrode element and the line $X'=x'_{bc}$ of the other element of the same discharge region so that the excitation of the gas atoms in this portion of the discharge region becomes possible with an even better efficiency, since the field therein is low but not zero.

One of the means of obtaining this region of low electric field $Z_W$ is to use electrode elements of variable length in the interval $[0, x_{bc}]$ (for the sake of consistency with the terms described above, the term "length" denotes the dimension measured perpendicular to the Ox axis).

If we define an ideal length profile of this element by the equation:

$$W_{e\text{-}id\text{-}0}(x)=W_{e\text{-}0}\exp\{29\sqrt{(P1/E1)(x-x_{ab})\times(V_{n\text{-}bc}-V_{n\text{-}ab})/(x_{bc}-x_{ab})}\}$$

where $W_{e\text{-}0}$ is the total width of said element measured at $x=x_0$ perpendicular to the Ox axis;

a lower limit profile $W_{e\text{-}id\text{-}low}$ and an upper limit profile $W_{e\text{-}id\text{-}up}$ according to the equations:

$$W_{e\text{-}id\text{-}low}=0.85W_{e\text{-}id\text{-}0} \text{ and } W_{e\text{-}id\text{-}up}=1.15W_{e\text{-}id\text{-}0},$$

then the preferred geometry of each coplanar electrode element is defined as follows. For any x lying within the interval $[0, x_{bc}]$, the total width $W_e(x)$ of said element, measured at x perpendicular to the Ox axis, is such that:

$$W_{e\text{-}id\text{-}low}(x)<W_e(x)<W_{e\text{-}id\text{-}up}(x).$$

Another means of obtaining this region of low electric field $Z_W$ is to use coplanar electrode elements that are subdivided, in the interval where x lies between x=0 and $x=x_{bc}$, into two lateral conducting elements that are symmetrical relative to the Ox axis.

A third means of obtaining this region of low electric field $Z_W$ is to use a dielectric layer 3 having specific electrical properties between the line x=0 and the line $x=_{bc}$.

If the specific longitudinal capacitance C(x) of the dielectric layer 3 is defined as the capacitance of a linear elementary bar of this layer, bounded between said electrode element and the surface of the dielectric layer, positioned at x on the Ox axis, having a "width" dx along this Ox axis and a "length" corresponding to that of the electrode element delimiting said elementary bar, this specific longitudinal capacitance C(x) of the dielectric layer increases in a continuous or discontinuous manner, without a decreasing part, from a value $C_0$ at the start x=0 of said interval to a value $C_{bc}$ at the end $x=x_{bc}$ of said interval.

Preferably, the capacitance of the dielectric layer portion 3 that lies between said element and the surface of this layer and which is bounded by said external edge where $x=L_E$ and the position $x=x_{bc}$ is strictly greater than the capacitance of the dielectric layer portion that lies between said element and the surface of this layer and is bounded by said internal edge where x=0 and the position $x=x_{ab}$.

Preferably, the specific longitudinal capacitance of the dielectric layer in the region lying between $x=x_{bc}$ and $x=L_E$ is greater than the specific longitudinal capacitance of the dielectric layer at any other position x such that $0<x<x_{bc}$.

The use of such a geometry of coplanar electrodes, or of such a gradient of dielectric properties of the dielectric layer that covers these electrodes, makes it possible to generate a region $Z_W$ of low electric field which has a width substantially greater than that of the gap, which makes it possible for the energy deposition in the gas excitation region to be made uniform and improved, and therefore makes it possible to further improve the luminous efficiency of the plasma display panel.

In this improvement of the invention, when the coplanar discharge forms and joins with the anodic portion of the matrix discharge, the coplanar discharge is not yet completely spread as far as the coplanar anode. Thanks to this improvement, the spread of the electrons at the coplanar anode is even more rapid and a discharge spread over the entire length of the discharge region is therefore obtained as rapidly as possible. When the coplanar discharge forms and joins with the anodic portion of the matrix discharge, the large coplanar discharge forms at the cathode depthwise, in the discharge path followed by the anodic spread of the matrix discharge.

In this improvement of the invention, a large-gap discharge is obtained (with a potential distributed quite uniformly between the two coplanar electrodes) while still maintaining a low ignition potential (since the electric field still remains high between the two internal edges of the coplanar electrodes).

The invention also applies to other image display devices provided with plasma display panels having coplanar electrodes, provided that they do not depart from the scope of the claims appended hereto.

The invention claimed is:

1. Image display device comprising:

a plasma display panel comprising a first plate provided with at least two arrays of coplanar electrodes (Y,Y') that are coated with a dielectric layer and a second plate provided with an array of electrodes (X) called address electrodes that are coated with a dielectric layer, forming between them a two-dimensional set of elementary discharge regions corresponding to pixels or subpixels of the images to be displayed, said regions being filled with a discharge gas and each being positioned at the point where an address electrode (X) crosses a pair or group of electrodes formed by an electrode of each coplanar array, each elementary discharge region being subdivided into:

a coplanar discharge region comprising a portion of the space between the plates that is located above the coplanar electrodes traversing this elementary region and between these electrodes, and each of said coplanar electrodes extending over its width between an edge called the internal edge, facing another of said coplanar electrodes, and an edge called the external edge at the limit of said coplanar discharge region;

at least two matrix discharge regions, each comprising a portion of the space between the plates that is located at the place where one of said coplanar electrodes crosses the address electrode traversing this elementary region, and being located closer to the external edge than the internal edge of said coplanar electrode with which this matrix discharge region is associated; and drive means for controlling the discharges in this panel, which are designed to generate, during display phases called sustain phases, series of a plurality of sustain voltage pulses between electrodes of said pairs or groups of coplanar electrodes so as to be able to cause discharges in coplanar regions of the elementary discharge regions traversed by these coplanar electrodes, wherein either said drive means for controlling the discharges are also designed so that, during any said sustain phase, the potential of the address electrodes is maintained at a value suitable for causing, before and at the start of each sustain pulse, a matrix discharge between the address electrodes and the electrodes of one of the coplanar arrays traversing said elementary discharge regions;

or said drive means for controlling the discharges are also designed to generate, before each sustain pulse of any said sustain phase, a matrix voltage pulse between the address electrodes and the electrodes of one of the coplanar arrays traversing said elementary discharge regions so as to cause a discharge in the matrix regions corresponding to the electrodes of said coplanar array.

2. Image display device of claim 1 wherein the gap separating the internal edges of the coplanar electrodes of each pair or each group is, in each coplanar discharge region, less than or equal to twice the average gap separating the two plates.

3. Image display device of claim 2 wherein the gap separating the internal edges of the coplanar electrodes of each pair or group of electrodes is less than or equal to 200 μm.

4. Image display device of claim 1 wherein on each row of elementary discharge regions, the dielectric layer covering the address electrodes on the second plate is subdivided into two types of adjacent regions/stripes:

a first type of regions/stripes of high dielectric permittivity, each located facing the rear half of a coplanar electrode of this row, near the external edge of this electrode; and a second type of region(s)/stripe(s) of low dielectric permittivity that are located between the high-permittivity first type of regions/stripes, wherein the average permittivity of the high-permittivity first type of regions/stripes being at least three times greater than that of the low-permittivity second type of region(s)/stripe(s).

5. Image display device of claim 1 wherein each column of elementary discharge regions is separated from an adjacent column by a barrier rib, and wherein in each elementary discharge region, each coplanar electrode traversing this region is indented along its width at the location of the two barrier ribs marking the boundary of this region up to an indentation limit located along said width closer to the external edge than the internal edge of this coplanar electrode.

6. Image display device of claim 1 wherein in each elementary discharge region of said plasma display panel, the average height of gas is lower at the rear halves of the coplanar electrodes than at the front halves of these electrodes.

7. Image display device of claim 1 wherein for each elementary discharge region of said plasma display panel and for each coplanar electrode traversing this region, the electrode area corresponding to the rear electrode half, which is bordered by its external edge, is higher than the electrode area corresponding to the front electrode half, which is bordered by its internal edge.

* * * * *